US005181360A

United States Patent [19]

Shingler

[11] Patent Number: 5,181,360

[45] Date of Patent: Jan. 26, 1993

[54] STANDING-SEAM ROOF PANEL SYSTEM

[75] Inventor: Thomas M. Shingler, Garland, Tex.

[73] Assignee: United Dominion Industries, Inc., Charlotte, N.C.

[21] Appl. No.: 759,532

[22] Filed: Sep. 13, 1991

[51] Int. Cl.[5] ..... E04D 1/00; E04D 1/34; E04B 1/34

[52] U.S. Cl. ..... 52/520; 52/544; 52/478; 52/547

[58] Field of Search ..... 52/531, 478, 537, 546, 52/544, 547, 520

[56] References Cited

U.S. PATENT DOCUMENTS

| | | | |
|---|---|---|---|
| 4,024,685 | 5/1977 | Aarons . | |
| 4,034,532 | 7/1977 | Reinwall, Jr. . | |
| 4,058,949 | 11/1977 | Bellem . | |
| 4,075,807 | 2/1978 | Alderman . | |
| 4,213,282 | 7/1980 | Heckelsberg | 52/478 |
| 4,296,581 | 10/1981 | Heckelsberg . | |
| 4,361,998 | 12/1982 | Ellison et al. . | |
| 4,495,743 | 1/1985 | Ellison et al. . | |
| 4,575,983 | 3/1986 | Lott, Jr. | 52/544 |
| 4,651,489 | 3/1987 | Hodges | 52/478 |
| 4,796,403 | 1/1989 | Fulton et al. . | |
| 5,001,882 | 3/1991 | Watkins | 52/547 |

OTHER PUBLICATIONS

AEP-SPAN "1990 Metal Roofing and Wall Systems" catalog, pp. 1, 5-7, 11.

*Primary Examiner*—David A. Scherbel
*Assistant Examiner*—Beth A. Aubrey
*Attorney, Agent, or Firm*—Kenneth R. Glaser

[57] ABSTRACT

A standing-seam roof system with elevated sub-purlins supported on concealed slip assemblies is provided. A uniform thermal-insulating value of the roof system is maintained by elevating the roof panels substantially above the undeformed depth of the thermal-insulating blanket. Each clip assembly consists of two parts allowing level adjustment after the fastening of the clip assembly.

7 Claims, 3 Drawing Sheets

STANDING-SEAM ROOF PANEL SYSTEM

FIELD OF INVENTION

This invention relates to metal roof panel systems and more particularly to standing-seam roof panel systems where adjacent sheet-metal panels have interlocking edges.

BACKGROUND OF THE INVENTION

Standing-seam roofs are widely used in commercial and high-quality residential building construction. Water-tightness of such roofs is ensured by providing standing seams at the edges of the sheet-metal panels, making fastener penetration through the surfaces of the panels unnecessary.

A typical standing-seam roof system includes spaced-apart purlins to secure and support the roof panels, a blanket of insulating material overlaying the purlins, and roof panels overlaying the insulating blanket.

A typical roof panel consists of a generally-flat surface, twelve inches to thirty inches wide, and two upstanding side legs forming a male profile on one side and a female profile on the other side. The panel is typically cold-formed from precoated metal having a thickness ranging from 0.016 inch to 0.05 inch.

The roof surface is typically formed by multiple panels engaged side-by-side and assembled in the following sequence. First, a thermal-insulating blanket is placed over the supporting roof purlins. A panel is then placed in position over the blanket. Clips holding the male-profiled leg of the panel in position are then fastened beside the panel edge to the supporting purlins through the thermal-insulating blanket. Finally, the female-profiled leg of the next panel is placed over the installed clips and caused to mechanically interlock with the male-profiled leg of the installed panel, using either a snap engagement profile design or a joint seaming machine. These steps are repeated until the entire roof area is covered.

Water leakage through the panel surface is prevented by elimination of fastener holes in the panel surface. Water leakage through the seams is prevented by the height of the seam legs and, optionally, a resilient seal along the panel seam.

The clips holding the panels to the supporting purlins are slidably engaged with the panel seams in the longitudinal direction, allowing free thermal movements of the panels and leading to long-lasting seal integrity. The upstanding seam profiles provide bending strength and stiffness against snow load and wind load. Wind uplift load is resisted by the hold-down clips. The interlocked seam provides resistance against separation under loads.

While this prior art system has performed well and met substantial commercial success, there are several drawbacks of the system that could be eliminated. First, the thermal-insulating blanket is compressed by the roof panels at the purlin locations. Blanket compression impairs the thermal efficiency of the insulation and in some cases leads to interior water condensation in cold weather. The compression of the thermal-insulating blanket is magnified by snow load on the roof. Blanket compression can also cause a visible distortion of the flat surface of the roof panel over the purlin locations, resulting in poor appearance.

A second drawback is that the precision-fit seams between roof panels require a close alignment tolerance on the purlins. The required purlin tolerance is not achievable using standard construction techniques. The prior art solution to this problem has been to use shims under the fastening clips; however, due to the compressibility of the thermal-insulating blanket, it is very difficult to predetermine the amount of shimming required before the clips are fastened down. As a result, time-consuming readjustments are often required.

Thus, a need presently exists for a standing-seam roof system which maintains the functional features of the prior art system while eliminating these drawbacks.

BRIEF DESCRIPTION OF THE DRAWINGS

The invention will be more readily appreciated when considering the following Detailed Description in conjunction with the Drawings, in which.

SUMMARY OF THE INVENTION

Figure 1:
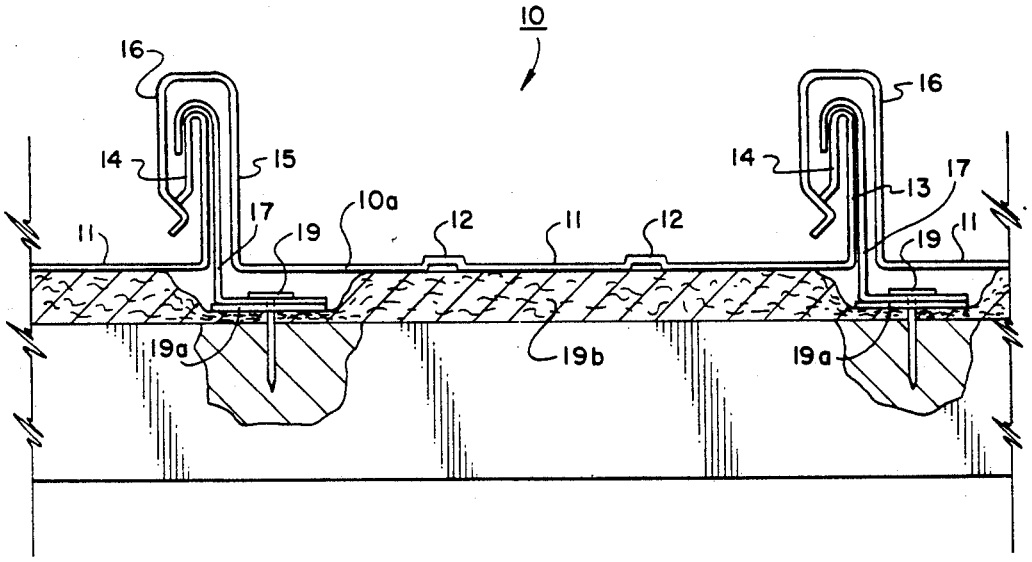
PRIOR ART FIG. 1
FIG. 1 is a partially broken-away end view of a prior art standing-seam roof system readily adaptable to the present invention.

The present invention is related to a standing-seam roof system. The assembled roof system includes multiple, spaced-apart roof purlins, a thermal-insulating blanket overlaying the roof purlins, clip assemblies providing support to sub-purlins positioned above the thermal-insulating blanket, each sub-purlin spanning the width of an individual roof panel as well a holding down the upstanding seams of the roof panels at the roof purlins, and multiple standing-seam roof panels engaged in a side-by-side fashion with mechanically-interlocked seams and vertically supported on top of the sub-purlins.

Each clip assembly comprises a top clip and a base clip slidably engaged in the vertical direction. (As used herein, the term "vertical" means in a direction perpendicular to the plane of the roof surface, and "horizontal" means in a direction parallel to the plane of the roof surface.) The top clip serves three functions holding down the male-profiled leg of the roof panel; engaging and supporting the sub-purlins; and permitting adjustment of the elevation of the erected roof surface The hold-down structure of the top clip allows free thermal movements of the roof panel in the longitudinal direction. The base clip consists of a vertical leg and a horizontal base flange and serves three functions: confinement of the top clip for vertically-slidable engagement; locking engagement with the top clip; and engagement of the clip assembly to a roof purlin.

Each sub-purlin consists of at least one top flange to provide the bearing surface for the roof panel and at least one vertical web to provide strength and stiffness of the sub-purlin. For structural efficiency, it is preferred to provide at least one bottom flange in the profile of the sub-purlin, along with two webs and two outwardly-extending top flanges. The lengths of the flanges match the width of the roof panel, while the webs are extended beyond the width of the roof panel at both ends to form end tabs which are compatible with vertical slots in the top clip portion of the clip assembly for horizontally-slidable engagement.

The installation procedure for the roof system includes the following steps exercised in sequence.

First, place the thermal-insulating blanket over the roof purlins.

Next, engage simultaneously the hold-down device of a clip assembly with the male-profiled leg of the roof panel and the vertical slots in the clip assembly with the end tabs of a sub-purlin, and fasten the base clip portion of the clip assembly through the thermal-insulating blanket into the roof purlin. In this step, the relative horizontal positions among the panel seam, sub-purlin, and the top clip portion are fixed.

Then adjust the vertical position of the male-profiled leg by vertically sliding the top clip portion relative the base clip portion and then by locking a deformable tab in the base clip portion into the nearest of several spaced-apart horizontal slots in the top clip portion. These steps are repeated at all roof purlin locations along the length of the roof panel.

Next, engage the left end of a new piece of sub-purlin into the vertical slots of an installed top clip portion. Repeat this step at all purlin locations along the length of the roof panel.

Engage the female-profiled leg of a new panel with the male-profiled leg of the just-installed panel.

Repeat the above steps until the entire roof area is covered. Finally, mechanically lock the female-profiled leg with the male-profiled leg for all seams using a roof seaming machine. This last step is not required in the case of a snap-lock seam design.

It can be seen that all the prior art drawbacks are eliminated by way of this invention. The sub-purlins supporting the roof panels are elevated above the thermal-insulating blanket, preventing compression of the thermal-insulating blanket and thus preserving a uniform thermal-insulating value over the entire roof area. The top flanges of the sub-purlin provide firm and even support for the panel, thus preventing pillowing of the roof panel. The elevation adjustment is made after the fastening of the clip assembly, eliminating the installation difficulties of the prior art system.

DETAILED DESCRIPTION OF THE PREFERRED EMBODIMENT

It was the design goal of the present invention to provide a standing-seam roof system having the following attributes:

1. Panel supports elevated above the thermal-insulating blanket such that the thermal-insulating value will not be impaired due to compression of the insulating blanket.

2. Metal sub-purlins to provide an even and rigid support of the flat portion of the roof panel surface.

3. Concealed connection clips allowing free longitudinal thermal movement of the roof panel and being sandwiched between the male-profiled leg of each panel and the female-profiled leg of its adjacent panel.

4. Two-part clip design allowing alignment adjustment after the fastening of the connection clip without the use of additional fasteners or shims.

5. Easy installation of sub-purlins without the use of additional fasteners.

Referring initially to FIG. 1, a typical prior art standing-seam roof system 10 adaptable to the present invention includes panel 10*a* having a generally flat central portion 11 with optional longitudinal stiffeners 12, one upstanding side leg 13 with male-profiled portion 14, and another upstanding side leg 15 with female-profiled portion 16. The female-profiled portion 16 is designed to mechanically interlock with the male-profiled portion 14 of the adjacent panel in a snap-engagement fashion. Clips 17 join the panels to purlin 18 by way of fasteners 19 and shims 19*a*. Thermal-insulating blanket 19*b* is compressed between central portion 11 and purlin 18. The present invention is adaptable not only to the type of snap-lock design shown in FIG. 1 but also to a machine-seamed seam design. The cover width of the panel 10*a* normally ranges from twelve inches to thirty inches. Commonly used materials include pre-coated steel, pre-coated aluminum, copper and stainless steel. The metal thickness normally ranges from 0.016 inch to 0.05 inch.

Figure 2:
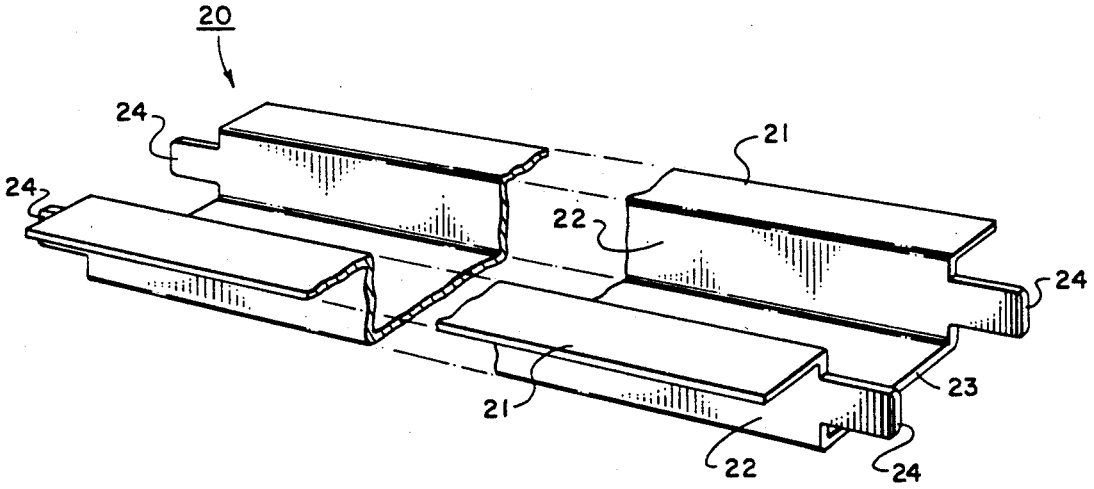
FIG. 2 is a partial perspective view of a sub-purlin usable with the present invention.

Referring now to FIG. 2, sub-purlin 20 of the present invention includes two top flanges 21, two vertical webs 22, and one bottom flange 23. The length of the flanges 21 and 23 is designed to be equal to or slightly less than the cover width of the panel 10*a*. The webs 22 are extended at both ends to form vertical end tabs 24. The sub-purlin 20 is preferably cold-formed from steel of thickness ranging from 0.03 inch to 0.06 inch. Many other equivalent profiles for the sub-purlin will be suggested to those skilled in the art.

Figure 3:
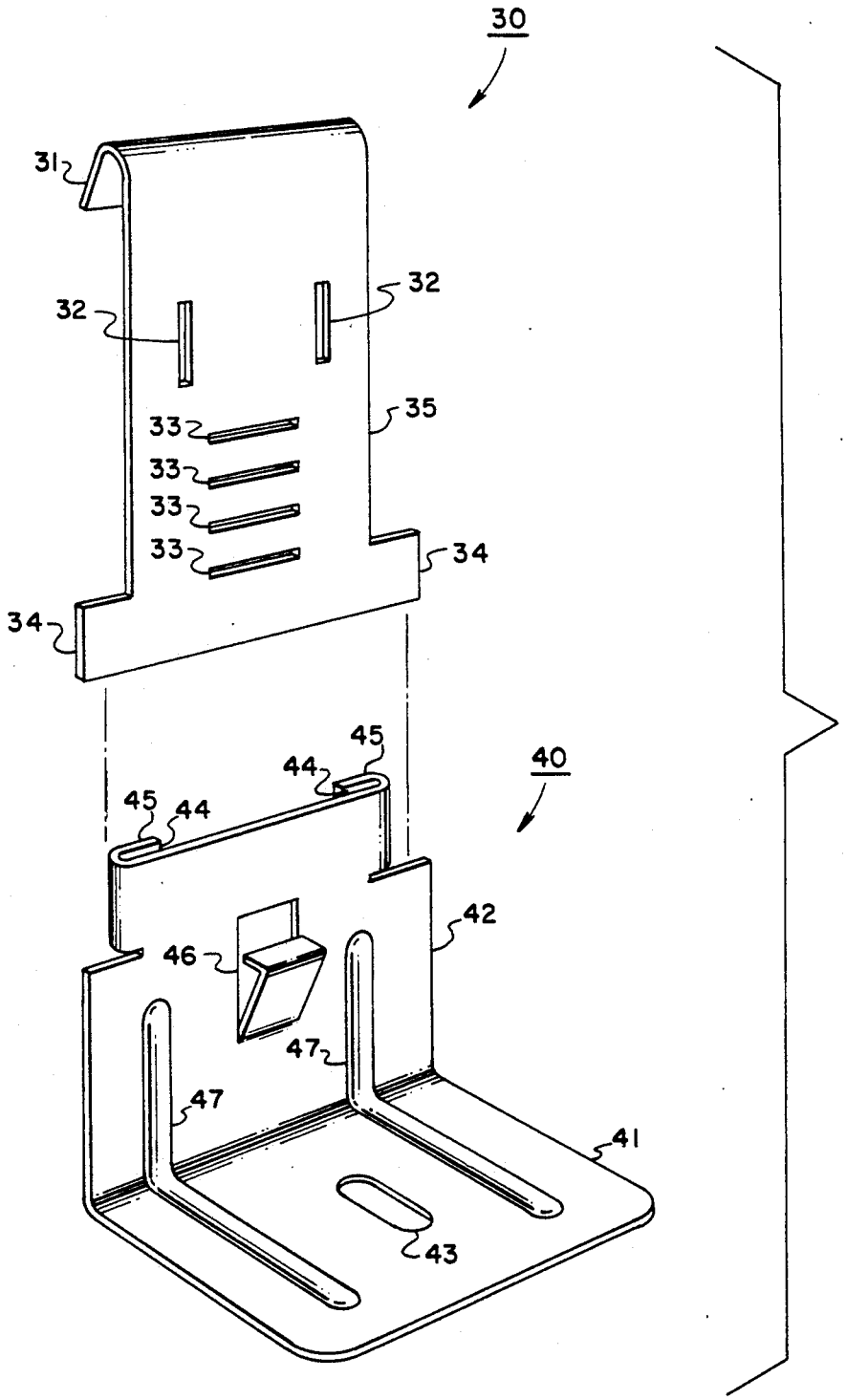
FIG. 3 is an exploded perspective view of the clip assembly of the present invention.
Figure 4:
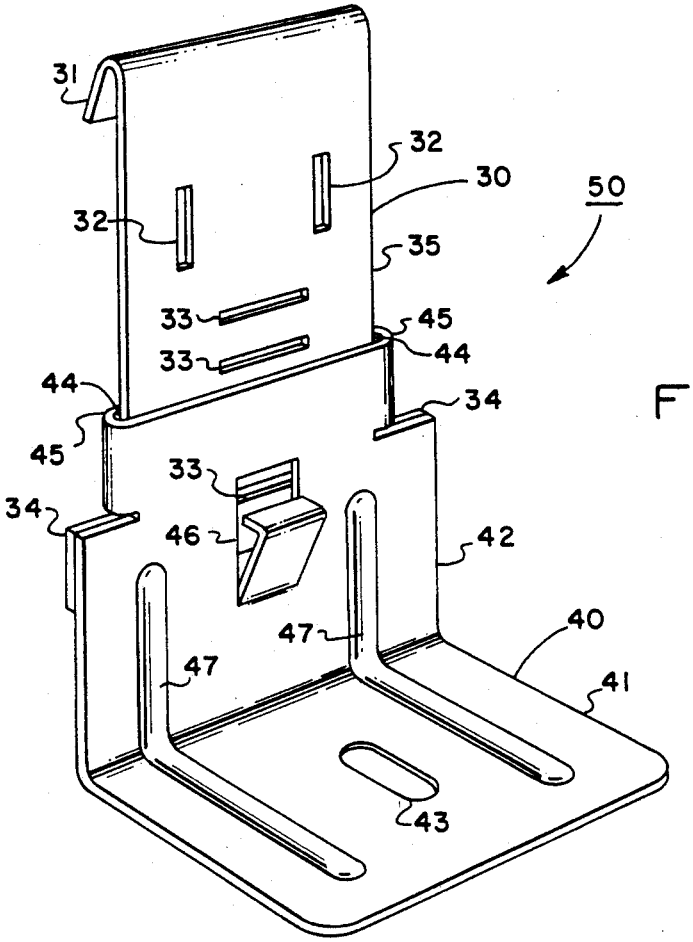
FIG. 4 is a perspective view of the assembled clip assembly of FIG. 3.

Referring now to FIGS. 3 and 4, top clip portion 30 consists of a vertical leg 35 and a top lip 31. The top clip portion 30 (FIG. 3) provides three functional features, namely, a top lip 31 to hold down the male-profiled portion 14 of the panel 10*a*, sub-purlin supporting slots 32 to engage the end tabs 24 and lock the sub-purlin 20 into position, and level-adjusting horizontal slots 33. The base tabs 34 are provided to keep the top clip portion 30 from separating from the preassembled clip assembly 50 (FIG. 4). The top clip portion 30 is preferably formed from steel of thicknesses ranging from 0.036 inch to 0.06 inch.

The base clip portion 40 (FIG. 3) consists of a horizontal leg 41 and a vertical leg 42. A screw hole 43 is provided in the horizontal leg 41. At the top portion of the vertical leg 42, vertical edge slots 44 are formed by wrapped-around edge lips 45. At the middle portion of the vertical leg 42, an integral deformable horizontal tab 46 is provided. The edge slots 44 are designed to contain the vertical leg 36 of the top clip portion 30 in a slidable engagement fashion. The horizontal tab 46 is designed to lock into one of the level adjusting slots 33 of the top clip portion 30. Embossed stiffeners 47 are preferable in order to increase the stiffness of the base clip portion 40. The base clip 40 is preferably made from steel in the thicknesses ranging from 0.036 inch to 0.06 inch.

FIG. 4 shows the preassembled clip assembly 50 comprising the top clip portion 30 and the base clip portion 40 in a vertically slidable relationship.

Figure 5:
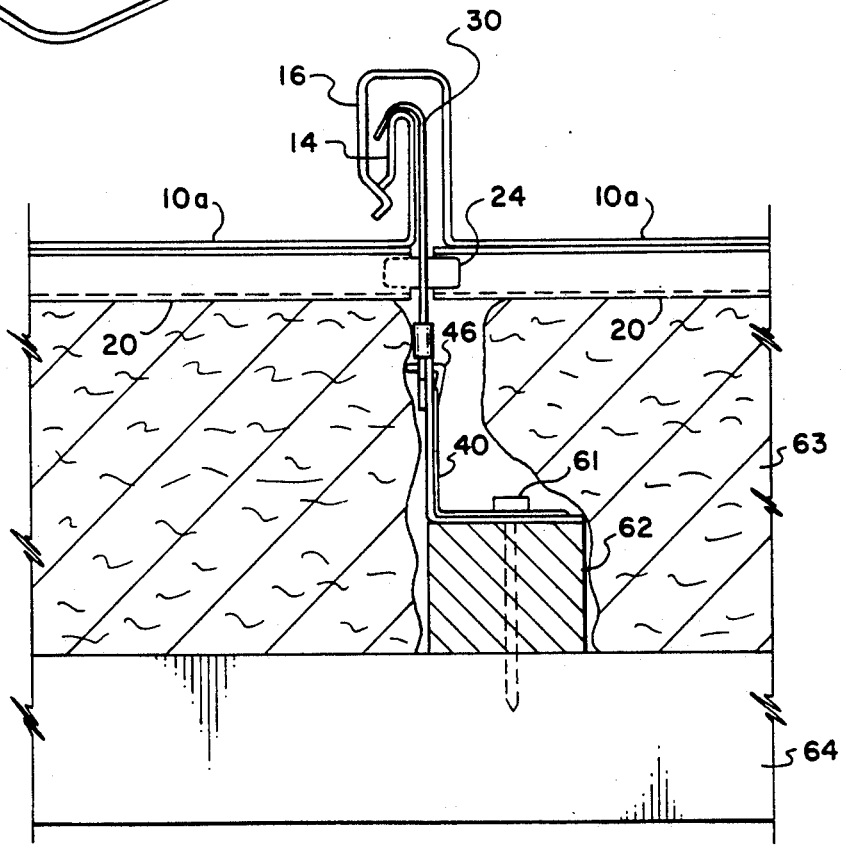
FIG. 5 is a partially broken-away end view of the installed roof system of the present invention.

In operation, as shown in FIG. 5, the first step in the installation is to hook the top clip portion 30 on the male-profiled portion 14 of the panel 10*a* on the left and to engage the end tabs 24 of the sub-purlin 20 on the left simultaneously. The second step is to fasten the base clip portion 40 to the roof purlin 64 using the screw 61. Rigid insulating block 62 may be used to absorb variations in the design depth of the insulating blanket 63. The third step is to slide the top clip portion 30 up or down to the desired level, then, the horizontal tab 46 of the base clip portion 40 is pressed into the nearest level adjusting slot 33 of the top clip portion 30 to lock the entire fastening system in position. The above three steps are repeated at all roof purlins along the length of the roof panel 10*a*. The fourth step is to engage the sub-purlins 20 on the right into the vertical slots 32 of the installed top clip portion 30 along the length of the roof panel 10*a*. The fifth step is to engage the female-profiled portion 16 of the next panel 10*a* on the right with the male-profiled portion 14 on the installed panel 10*a* on the left. Then, the erection processes are repeated for the newly-placed panel 10*a*.

It can thus be seen that the roof panels 10*a* are rigidly supported on sub-purlins 20 which are elevated above the insulating blanket 63, eliminating the impairment of the thermal insulation value of the prior art system due to a compression of the insulating blanket. It can also be seen that the alignment adjustments are performed after the fastening of the base clip portion 40, thereby eliminating the difficulties of adjustments in the prior art system.

While I have illustrated and described certain preferred embodiments of the present invention, it is to be understood that the invention is not limited thereto, and numerous equivalent constructions may be embraced within the scope of the following claims.

I claim:

1. A standing-seam roof system supported by at least two spaced-apart transverse roof purlins, comprising:

multiple standing-seam roof panels each having an essentially flat central portion and two upstanding side legs profiled into a pair of compatible, interlocking male and female-profiled portions, said roof panels being assembled in a side-by-side fashion with a series of mechanically interlocked seams;

a layer of thermal-insulating blanket being sandwiched between said roof panels and said roof purlins;

said roof panels being secured by concealed clip assemblies engaged with said panels at said seams, said clip assemblies being fastened to said roof purlins and comprising a top clip portion and a base clip portion means for vertically adjusting the clip relative to the baseclip;

hold-down means for engaging said seam, said hold-down means being with said top clip; and means for interlocking said top clip portion and said base clip portion, such that said roof panels are installed without substantial compression of said thermal-insulating blanket.

2. The system of claim 1 where the top clip portion and a base clip portion are connected for vertically slidable movements relative one another.

3. The system of claim 1 where the hold-down means is a lip formed on said top clip portion and sandwiched between said male- and female-profiled portions of each of said interlocked seams.

4. The system of claim 1 wherein the means for interlocking includes multiple, vertically spaced-apart, horizontal slots in the top clip portion and an integral deformable horizontal tab in the base clip portion, said horizontal tab being compatible with said horizontal slots for locking engagement.

5. The system of claim 1, further comprising:

sub-purlins underlying said roof panels, spanning the width of each of said roof panels, and bridging between two adjacent said clip assemblies along the length of each of said roof purlins;

said sub-purlins being elevated above said thermal-insulating blanket; and connection means being provided for securing said sub-purlins to said clip assemblies.

6. The system of claim 5 with each of said sub-purlins comprising at least one horizontal top flange and at least one vertical web integrally connected with said top flange.

7. The system of claim 6 wherein said connection means includes an end tab extending from each web of said sub-purlin and vertical slots compatible with said end tabs in said clip assemblies.

* * * * *

UNITED STATES PATENT AND TRADEMARK OFFICE

CERTIFICATE OF CORRECTION

PATENT NO. : 5,181,360

DATED : January 26, 1993

INVENTOR(S) : Thomas M. Shingler

It is certified that error appears in the above-identified patent and that said Letters Patent is hereby corrected as shown below:

Column 6, line 1, insert "top" before "clip" (second occurrence)

Signed and Sealed this

Second Day of November, 1993

*Attest:*

*Attesting Officer*

BRUCE LEHMAN

*Commissioner of Patents and Trademarks*